US005577659A

United States Patent [19]

Ades

[11] Patent Number: 5,577,659

[45] Date of Patent: Nov. 26, 1996

[54] LOCKING FEATURE FOR CONTAINER

[75] Inventor: Craig A. Ades, Yuma, Ariz.

[73] Assignee: Weyerhaeuser Company, Tacoma, Wash.

[21] Appl. No.: 488,637

[22] Filed: Jun. 8, 1995

[51] Int. Cl.[6] ..... B65D 43/02

[52] U.S. Cl. ..... 229/125.29; 229/23 BT; 229/125.32

[58] Field of Search ..... 229/23 R, 23 BT, 229/117.16, 117.17, 125.29, 125.32

[56] References Cited

U.S. PATENT DOCUMENTS

| | | | |
|---|---|---|---|
| 1,649,591 | 11/1927 | Honigbaum | 229/125.29 |
| 2,393,356 | 1/1946 | Fallert | 229/125.29 |
| 2,407,463 | 9/1946 | Williams | 229/117.16 |
| 2,618,429 | 11/1952 | Donnell | 229/125.29 |
| 2,711,281 | 6/1955 | Argodale | 229/125.29 |
| 2,718,996 | 9/1955 | Jamieson | 229/125.29 |
| 2,766,921 | 10/1956 | Jones et al. | 229/23 R |
| 2,768,778 | 10/1956 | Ferguson et al. | 229/125.29 |
| 4,331,235 | 5/1982 | Brundage | 229/117.16 |
| 5,443,205 | 8/1995 | Robotham et al. | 229/125.32 |
| 5,447,225 | 9/1995 | Gunn et al. | 229/125.32 |

*Primary Examiner*—Gary E. Elkins

[57] ABSTRACT

A removable locking feature for joining two members together has a locking strap cut from an upper member with a plurality of parts separated by hinges. A lower member has a slot structure locking tab through which the locking strap will pass for locking. Through pivoting action of a locking key on the strap the strap can be locked and thereafter readily unlocked.

3 Claims, 4 Drawing Sheets

Fig. 2
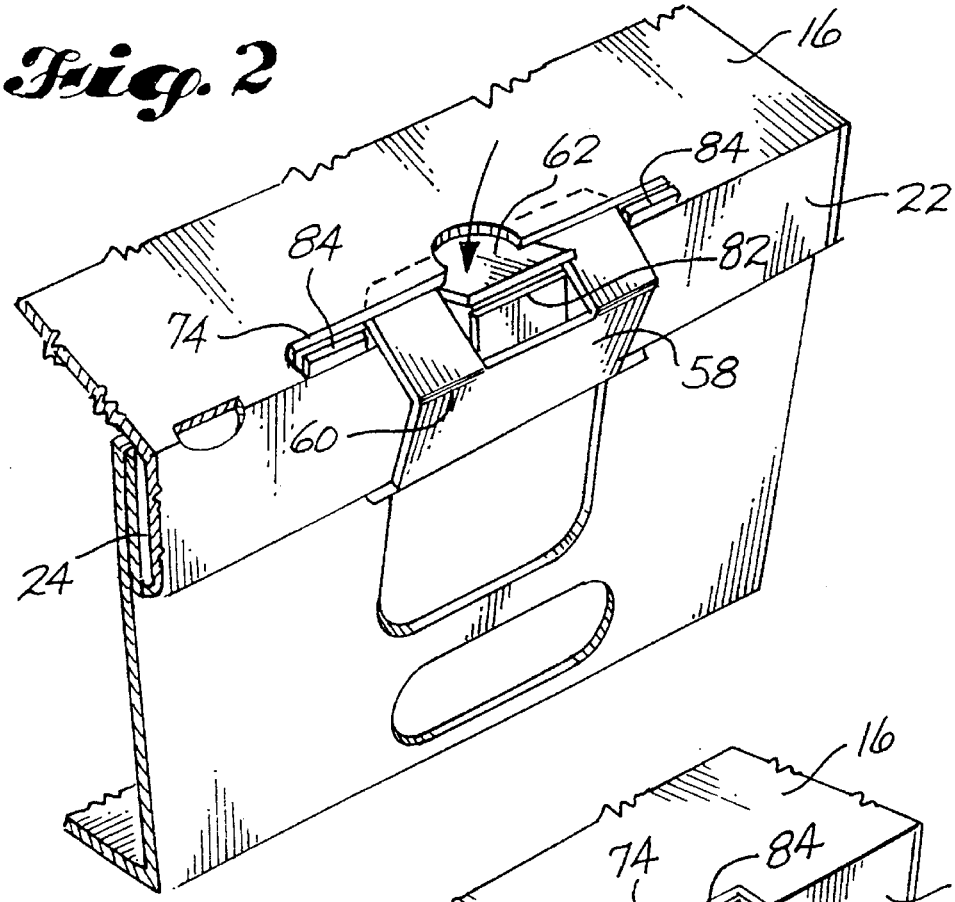
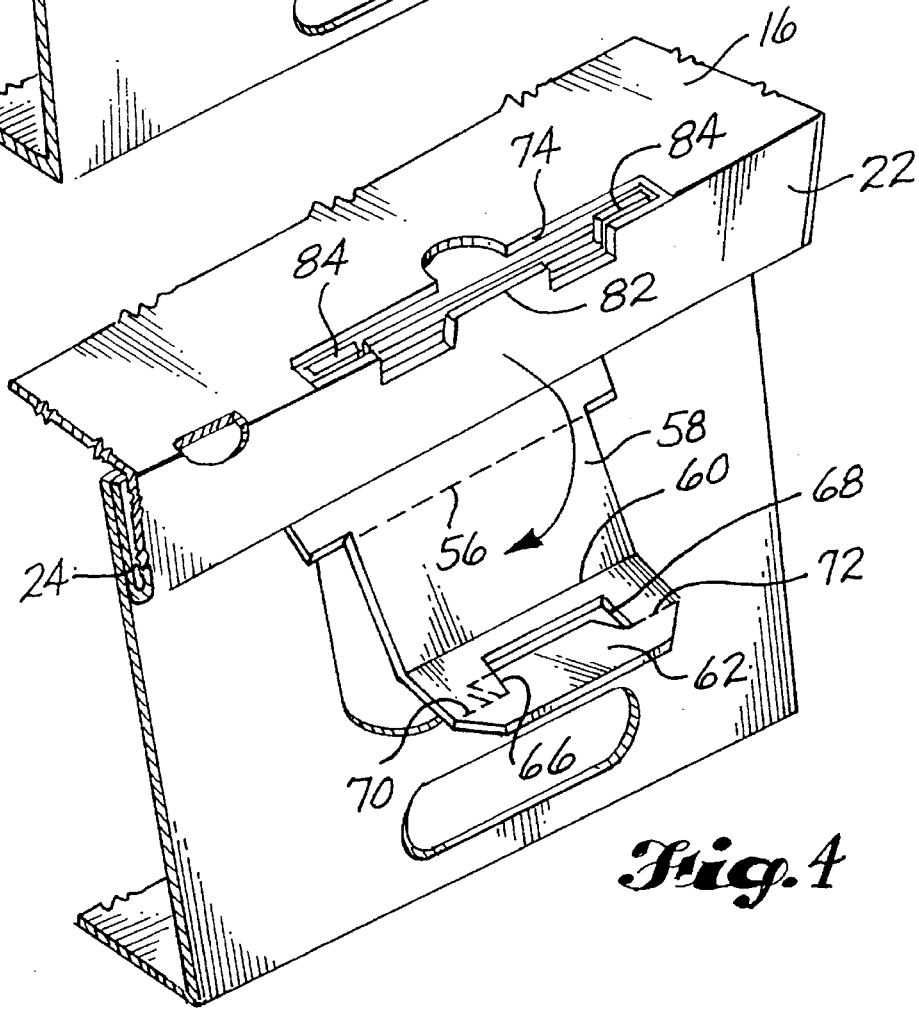
Fig. 4

LOCKING FEATURE FOR CONTAINER

BACKGROUND OF THE INVENTION

This invention relates generally to packaging products and more particularly to an improvement where a first member can be removably locked to a second member.

Over the years there have been many locking means proposed to removably lock members of a multi-pan package together. In a package design for asparagus a two-piece corrugated paperboard design is comprised of a bottom tray with short side walls and a top cover with inclined side walls that covers the upstanding asparagus by being telescoped within the tray. For shipment the top cover needs to be removably locked to the bottom tray. There are also single-piece asparagus containers where the container is erected and closed by suitable removable locking means alter the asparagus is placed.

The present invention, while useful as a locking feature for a two-piece asparagus container can be readily adapted to other uses. In addition, while it is particularly useful when the container is comprised of corrugated paperboard, it will also be adaptable for other packaging materials.

Accordingly, from the foregoing, one object of the present invention is the provision of an improved locking feature to removably secure a top of a container to a bottom tray.

Another object is to utilize portions of the packaging materials, cut and scored, to form the improved locking means.

These and other objects will become apparent upon reviewing the detailed description in combination with the drawings.

SUMMARY OF THE INVENTION

Briefly stated, the present invention is practiced in one form by providing a hinged foldable locking strap in one member and a slot in an adjacent member where the strap will fold over a portion of the adjacent member and the strap end will be removably locked to a tab extending downwardly into the slot.

BRIEF DESCRIPTION OF THE DRAWINGS

FIG. 2 is an exploded view showing one locking strap in a partially folded position prior to being removably locked in place.

FIG. 4 shows the locking strap being released.

DETAILED DESCRIPTION OF THE PREFERRED EMBODIMENT

Figure 1A:
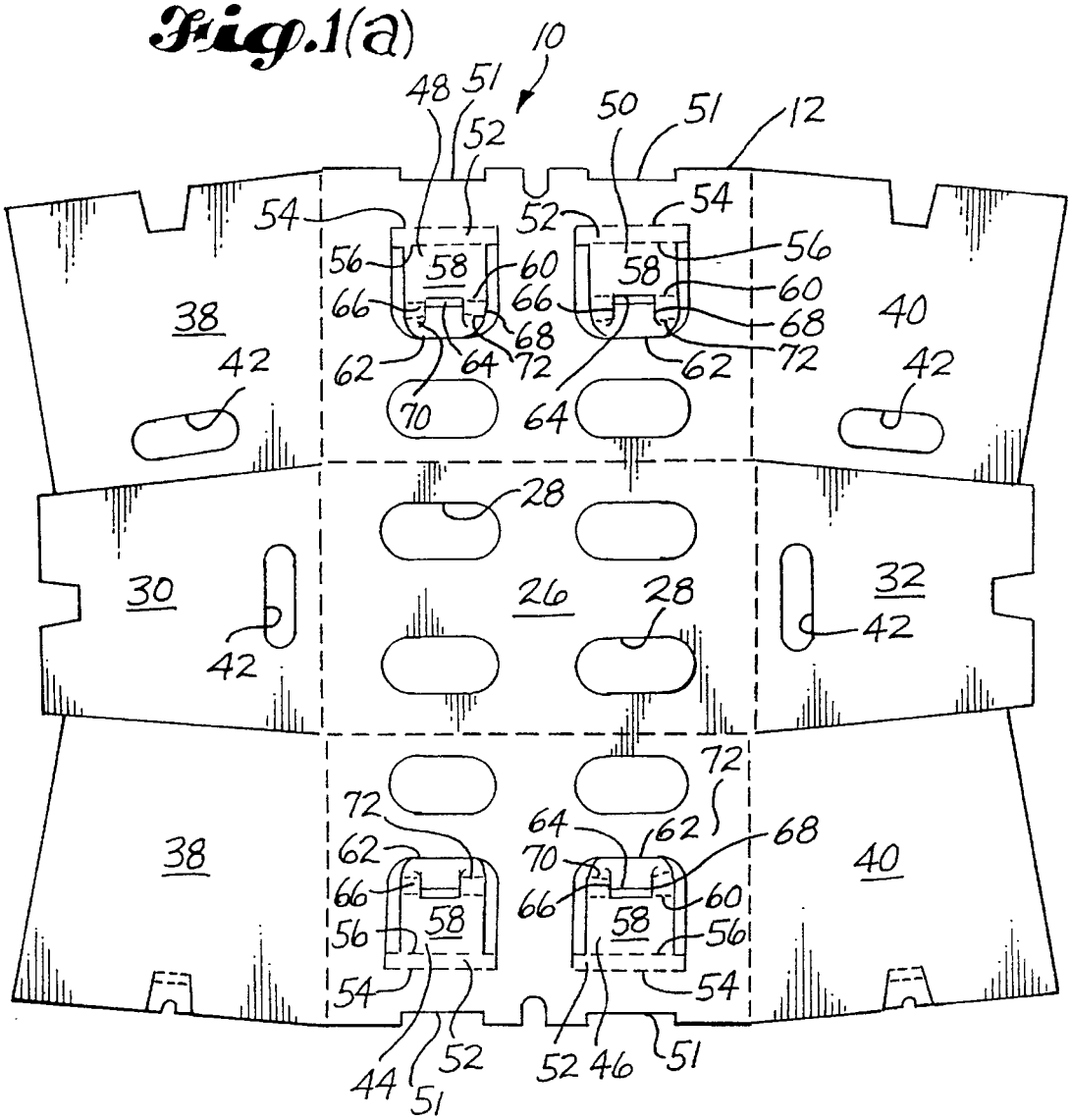
FIGS. 1(*a*) and 1(*b*) illustrate a plan view of the blanks for the top and bottom members of a two-piece container.
Figure 1B:
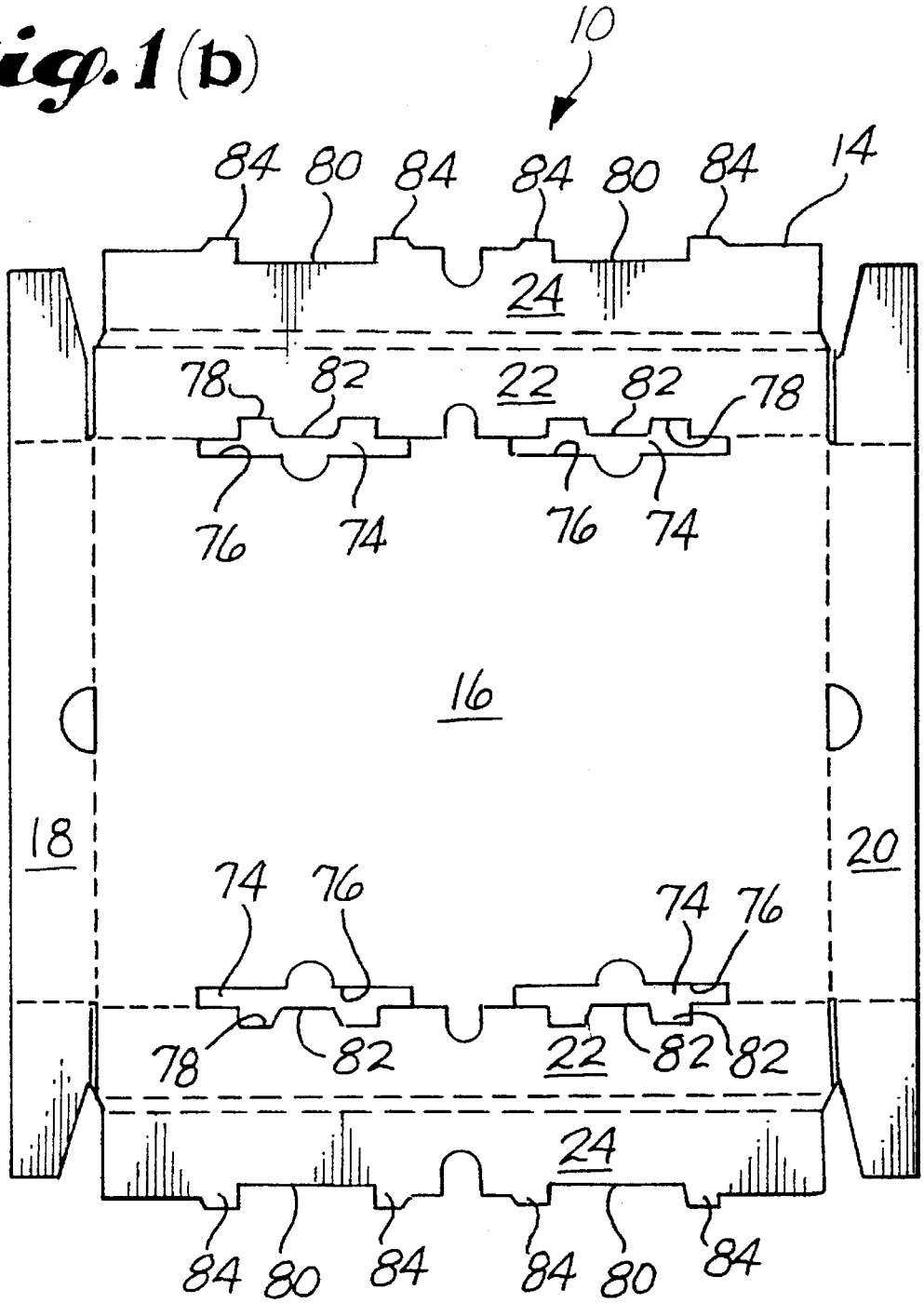
Figure 3:
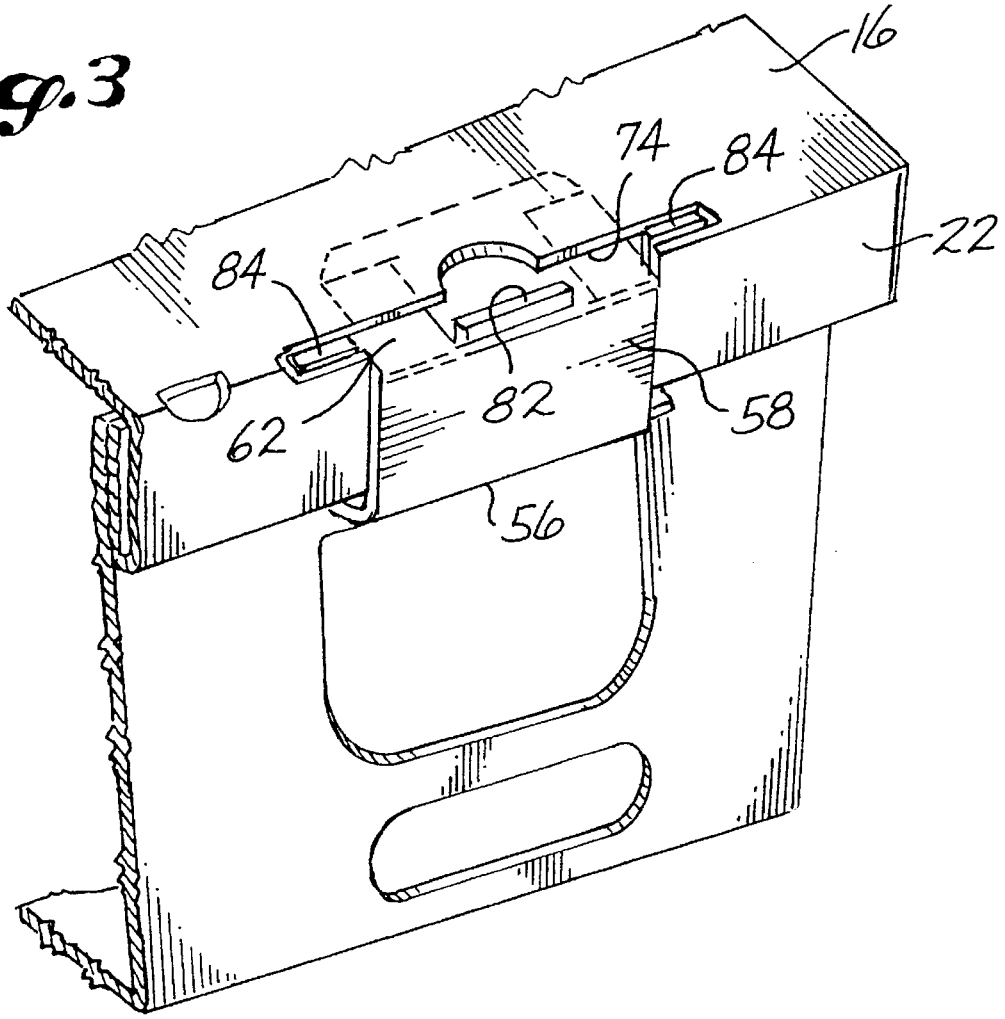
FIG. 3 is a similar exploded view showing the locking strap as it is locked in place.

Referring first to FIGS. 1(*a*) and 1(*b*) a two-piece container (each blank) is generally indicated at 10. Top blank 12 and bottom blank 14 in this embodiment are designed for use, when erected, as a typical corrugated paperboard two-piece asparagus container. Such containers are well known and have been commercially used for many years. Bottom blank 14 is cut, scored and folded to form a typical "tray" type configuration; however, with provision for specifically designed slot structures as will be described in detail later. The regular elements in blank 14 are bottom wall 16, end walls 18, 20, and double wall side panels with each side panel having a first or inner panel 22 and a second or outer panel 24.

Top blank 12 is constructed in a typical manner, likewise with a special provision for a part of the present invention and has top panel 26 with four apertures 28 spaced therein to provide air and/or coolant flow. Hinged to either end of panel 26 will be opposed downwardly depending end panels 30, 32 and similarly hinged to panel 26 will be opposed downwardly depending side panels 34, 36. Hinged from either end of panels 34, 36 are additional interior first and second end wall panels 38, 40 that together with end panels 30, 32 form three layer end walls in the top of the container. When folded up and locked to form the typical trapezoidal shaped top cover which is sized so as to slide downwardly with the bottom tray, a plurality of elongated hand hold slots, each indicated at 42, will be in line and arranged at the top of the container filled with asparagus. When such lifting occurs it, of course, becomes essential that the tray holding the asparagus not disengage from the top.

Details of the present invention will now be described. Designed into each side panel are laterally spaced pairs of locking straps 44, 46 and 48, 50, respectively. While pairs are shown, the invention in its broad sense is one locking strap with one cooperating locking slot in an underlying member. Since the invention is being illustrated in use for a typical two-piece corrugated paperboard asparagus container, pairs are provided and they are sized in order to provide sufficient holding and locking power for a container filled with asparagus. Each strap will be die cut into the flat paperboard blank and the necessary score lines established. To accommodate the locking strap when it will be folded into its locking arrangement to securely hold the top to the bottom are elongated cutouts 51 along the side edges of panels 34, 36. The length will be equal to or slightly greater than the width of a locking strap and their height will be equal to or slightly greater than the thickness of the locking strap material. Each strap begins with a linear panel 52 separated by opposed score lines 54, 56. The distance from each score line 54 to the bottom edge of its respective side wall will approximate the height dimension of the side walls of the bottom tray. Extending outwardly from score line 56 is first major strap panel 58 which extends outwardly for a distance which also approximates the height dimension of the side walls on the bottom tray. Extending further outwardly from major panel 58 along a score line 60 is the locking key panel 62. Positioned centrally along score line 60 is a slot 64 which is sized to have a width approximately equal to the thickness of the corrugated paperboard material and a length approximately equal to the length of a downwardly depending tab within the panels 24 as will become more apparent later. Opposed slits 66, 68 extend outwardly from either outer corner of slot 64 and terminate at the inner ends of short opposed laterally extending hinge lines 70, 72. Thus, it will be appreciated that key panel 62 is hinged about lines 70, 72 and its length will be established to provide enough material within key panel 62 to assure sufficient locking forces when the locking strap is folded over the bottom side wall and the key panel 62 locked to it.

Within bottom blank 14, as previously noted, is a particular slot and tab structure that allows the locking strap to enter the slot and removably engage the locking tab. In bottom blank 14 there are four elongated slots, each indicated at 74, with a portion 76 of each in bottom wall 16 and a slightly shorter portion 78 in first panel 22. The width of each portion is approximately the thickness of the material comprising the paperboard or other suitable material comprising the locking strap and the bottom member. Within the outer edge of the second or outer side panels 24 are elongated cutouts, each indicated at 80, and with the width of each being greater than the thickness of the locking strap material. Centered within each cutout 78 and having a length equal to or slightly less than slots 64 are rigid locking tabs 82. The width of each tab 82 is sized to be slightly greater than the thickness of the locking strap material. On either side of cutouts 80 are the downwardly depending locking tabs 84 that will be locked within portions 76 of slots 74 after the first and second panels are folded over and locked in place to form the side panels in the bottom tray.

Turning now to the additional figures, the operation of the present invention will be described. First, it will be assumed that since the two-piece container construction is well known, anyone with ordinary skill can form the bottom tray and the top telescoping cover. With the bottom tray a suitable collection of asparagus, or any other product to be packaged, is placed within the bottom tray. Next the top cover is placed over the product and the bottom portions of the side walls slide downwardly just inside the tray side and end walls. The planer bottom edge of the top cover will come to rest atop the upper surface of the tray's bottom wall. Now the two parts are ready to be removably locked for handling, shipment, etc.

First, the locking strap will be pulled outwardly away from the cover side wall and bent downwardly about score lines 54, 56 and 60. The material between score lines 54, 56 will span the top edge of the underlying portion of the bottom tray while the material in panel 58 will extend over the height of the tray side wall and be juxtaposed thereto. Next, the key panel will be bent about hinge lines 70, 72 and its score line 60 and inserted through the slots within the underlying bottom tray. The pivoting action is sufficient to allow the key panel 62 to pivot upwardly, avoiding the adjacent locking tab 84, while being pushed into the slot. As major panel 58 comes to rest against the bottom tray side wall, the slot 64 will come into alignment with the adjacent rigid locking tab 82. Key panel 62 is then pivoted in the opposite direction to removably lock the strap in place. Key panel 62 will then be lying horizontal and at rest atop the adjacent portion of the bottom tray wall.

To unlock the strap a person's hand is inserted through the cutout portion in the cover side wall created when the strap is folded over. The fingers are used to grasp an outer edge of locking key 62 to pull it upwardly causing key 62 to pivot about hinge lines 70, 72. At the same time key 62 is pushed outwardly while the inner edge of key 62 slips past the locking tab 82. As key 62 is pushed further outwardly, it also begins bending about score line 60. At this point the entire locking key is in front of the locking tab and it can be pivoted back upwardly to remove the locking strap from the slot structure with the bottom tray. Once all locking straps are removed the top cover can be withdrawn from the bottom tray.

Thus, what has been described is an improved locking feature for a package, especially useful for two-piece corrugated paperboard containers. In its broad scope, however, it can be used in any application where two members are to be removably joined together. Many modifications may occur to those skilled in the art and all such modifications are intended to come within the scope of the following claims.

I claim:

1. A two piece container for packaging product, in which a bottom tray has a bottom wall with an upper surface and upstanding side walls and a telescoping top cover having downwardly depending side walls such that said side walls on the cover slide within and are juxtaposed to the upstanding side walls, having the improvement comprising:

at least one slot with a top edge in at least one of the tray side walls extending along a lower edge thereof and having a width large enough to accept the at least one slot with a top edge in at least one of the tray side walls extending along a lower edge thereof and having a width large enough to accept the thickness of the paperboard within that portion of the top cover in proximity to the at least one slot, a hinged foldable locking strap having an outer end cut from a portion of the side wall on the cover in proximity to the at least one slot and having at least two hinge lines therein extending substantially parallel to the slot and adapted to be folded outwardly, downwardly, over a juxtaposed portion of the upstanding side wall, and into the slot where it removably holds the top cover to the bottom tray and a tab extending downwardly from the top edge of the slot and terminating above the plane of the bottom surface of the bottom tray and a flexible hooking means in the locking strap proximate to its outer end for flexibly engaging the tab and removably locking the strap within the slot in the bottom tray.

2. The improvement as in claim 1 in which the hooking means includes a pivotal locking key with a slot hinged to the locking strap at its outer end and adapted to have one inner edge of the slot engage and abut the downwardly extending tab.

3. The improvement as in claim 1 in which the distance between the at least two hinge lines is approximately the same as the height dimension of the adjacent tray side wall.

* * * * *